US005882148A

United States Patent [19]

Mraz

[11] Patent Number: 5,882,148

[45] Date of Patent: Mar. 16, 1999

[54] APPARATUS FOR YIELDING SUPPORT OF ROCK

[75] Inventor: Dennis Mraz, Saskatoon, Canada

[73] Assignee: DM Technologies Ltd., Canada

[21] Appl. No.: 796,186

[22] Filed: Feb. 7, 1997

[51] Int. Cl.[6] ..... E21D 20/00; E21D 21/00; E21D 23/16; E21D 23/26

[52] U.S. Cl. ..... 405/259.1; 411/9; 411/10

[58] Field of Search ..... 405/259.1, 259.2, 405/259.6; 411/9, 10, 531, 545

[56] References Cited

U.S. PATENT DOCUMENTS 4,295,760 10/1981 Warner ..... 405/259.1
4,984,937 1/1991 Karpellus ..... 405/259.1 X

*Primary Examiner*—Tamara L. Graysay
*Assistant Examiner*—Tara L. Mayo
*Attorney, Agent, or Firm*—Morgan & Finnegan, L.L.P.

[57] ABSTRACT

An apparatus for yielding rock support in a rock bolt where yielding is achieved by one or more yielding elements at one or more levels of loading.

8 Claims, 11 Drawing Sheets

APPARATUS FOR YIELDING SUPPORT OF ROCK

FIELD OF THE INVENTION

The present invention relates generally to support of rock and specifically to support of rock with yielding rock bolts.

DESCRIPTION OF THE RELATED ART

In many rocks, in order to achieve effective rock support over a desired length of time, the means of support must accommodate rock expansion by yielding. Particularly in the mines prone t rock bursts, large displacements are encountered during the rock burst events, which can cause failure of rock support such as rock bolts.

In rock bolts, extension is achieved by utilizing one or more of the following methods.

In the expansion type mechanical rock bolt shells, a steel wedge gradually slips between two or more segments of a cylindrical steel sleeve, forcing them into surrounding rock. This provides more or less constant friction force between the sleeve segments and the wedge, allowing a moderate rock bolt extension while providing continuous support to the rock. While this method of yielding rock support is relatively reliable, it can accommodate only a moderate rock bolt extension before the wedge slips through the shell and the rock bolt fails.

The split set type rock bolt is a pipe with a slot. During installation it is forced into a drill hole which is slightly smaller than the split set, forcing it to deform. This deformation provides a friction force between the split set and the hole in the rock. The rock expansion is accommodated by slippage of the split set within the hole when the supported load exceeds the friction force. While this method can accommodate larger expansions of rocks, it is less reliable than expansion shells and not suitable in many applications.

Another method of yielding rock support involves placing an oversized steel plug within a steel pipe in series with a standard rock bolt anchor. When an unusually large rock expansion occurs, the plug slips within the pipe while expanding it. Although this method provides a larger rock bolt extension than a mechanical expansion shell, it is less reliable and it's rock support performance is less predictable.

It would be therefore desirable to obtain a method and apparatus for a yielding rock support, which would allow a relatively large rock bolt extensions, while reliably maintaining a relatively constant force of rock support.

SUMMARY OF THE INVENTION

An object of the present invention is to proved a method of rock support, which allows relatively large rock displacements while reliably maintaining rock support force within a predetermined range.

Another object of the present invention is to provide a reliable rock support force at two or three levels of loading, in order to accommodate both, the smaller rock displacements due to rock excavations and large rock displacements due to rock bursts.

Yet another object of the present invention is to provide means of rock support capable of maintaining rock support force within predetermined ranges while accommodating relatively large rock displacements.

These and other objects of the present invention are met by a method and apparatus according to which means of rock support expands at two or more predetermined levels of loading at two or more rates of extension, while maintaining reliable rock support within a relatively large range of extension.

DETAILED DESCRIPTION OF THE PREFERRED EMBODIMENTS

Figure 1:
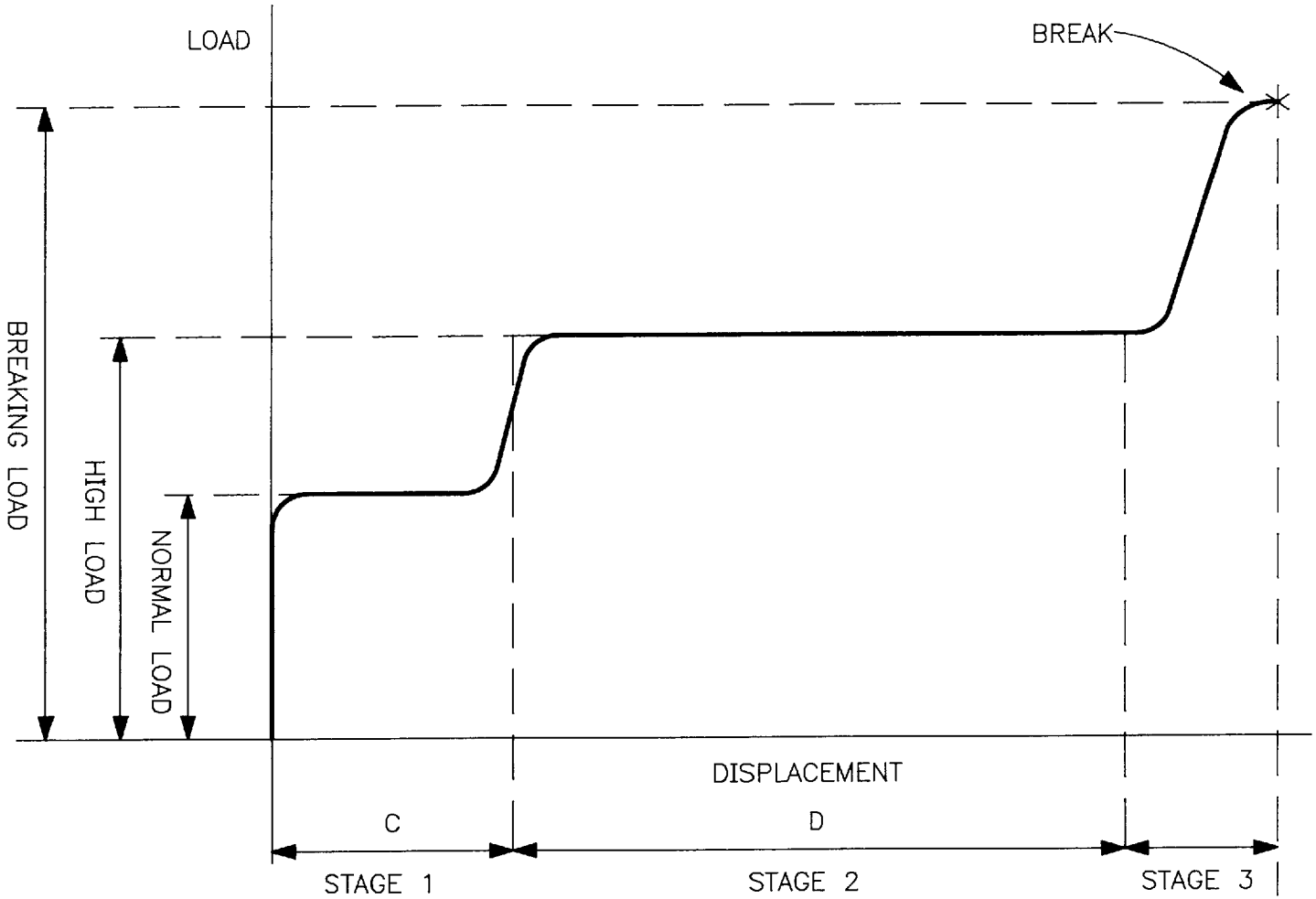
FIGS. 1 and 2 are schematic diagrams of displacements at three levels of loading according to the present invention.

FIG. 1 schematically illustrates the preferred method of rock support according to the present invention. The rock support is accomplished in three stages. After the initial tensioning of the means of support to the level of normal operating load, the level of load is maintained at this level during the stage 1 within the range of displacement C. If at any time during the stage 1 the load level increases beyond the normal load, such as during a rock burst, displacement rate increases but the normal level of load is maintained. If the higher than normal level of load continues, the displacement reaches the final value C and the stage 2 begins. During the stage 2 the high level of load is maintained within the range of displacement D. The rock continues to be supported safely as long as the displacement does not exceed the combined length of C. and D. Once the final value of displacement D is reached, the stage 3 begins. If during stage 3 the level of load continues to increases, the means of support reaches the breaking point.

Figure 2:
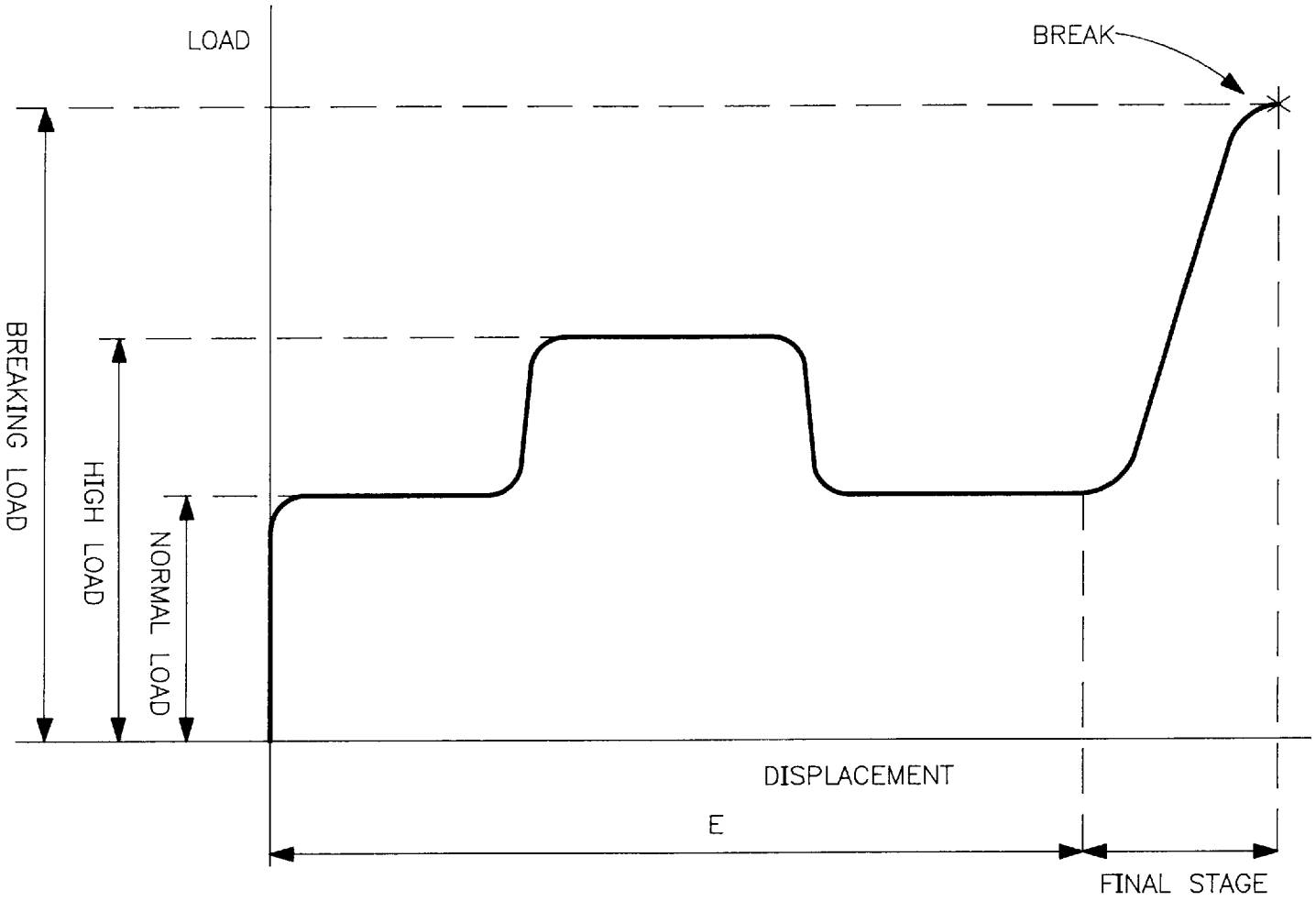

FIG. 2 schematically illustrates another method of rock support according to the present invention. After the initial tensioning of the means of support to the level of normal operating load, the normal level of load is maintained within the range of displacement E. If at any time the load level increases beyond the normal load to a high load level, displacement rate increases and the high level of load is maintained until the load decreases again to a normal level. The rock continues to be supported safely as long as the displacement does not exceed the length of E. Once the final value of displacement E is reached, the final stage begins. If during the final stage the level of load continues to increase, the means of support reaches the breaking point.

Figure 3:
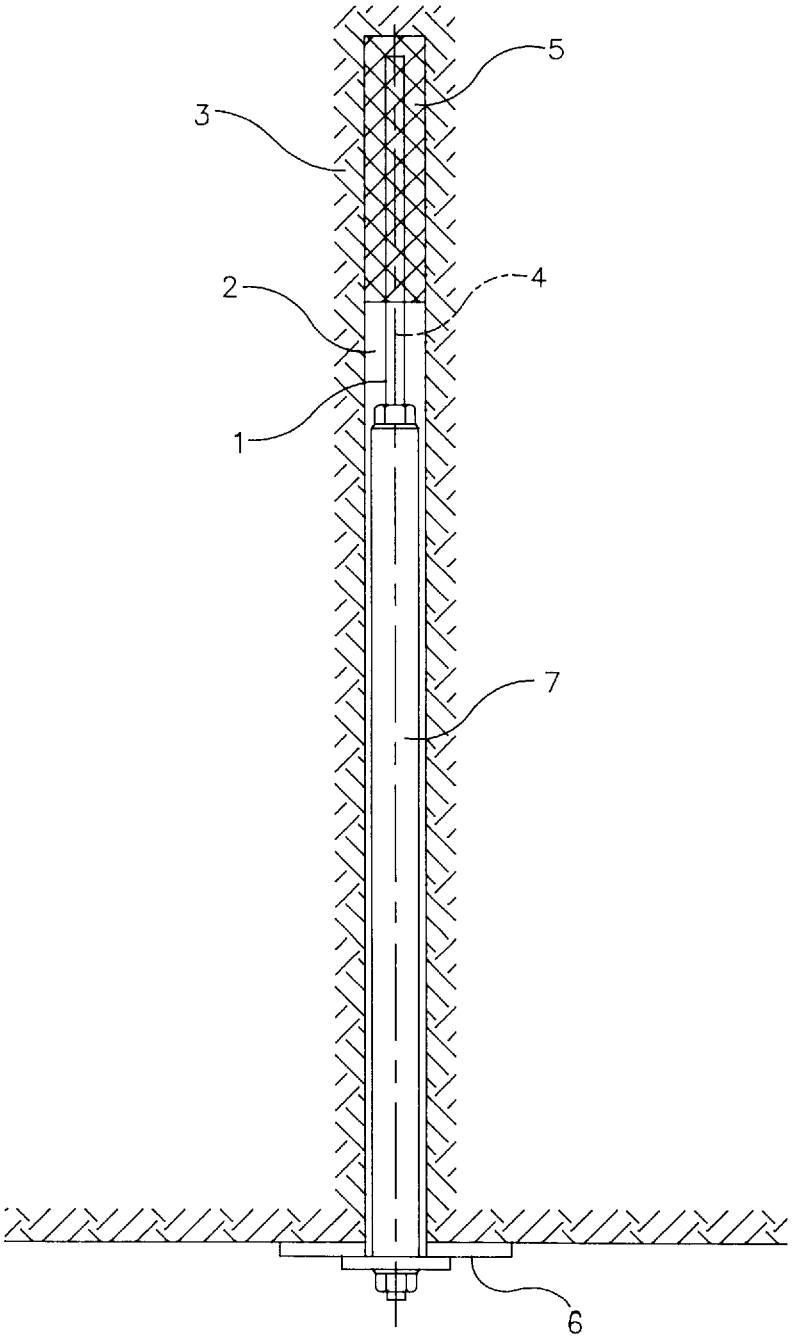
FIG. 3 is a side view cross section of the preferred embodiment of a yielding rock bolt according to the present invention.

The side view cross section of a preferred embodiment of a yielding rock support according to the present invention is illustrated in FIG. 3. Rock bolt assembly 1 installed in the hole 2 within rock 3 consist of a steel rod 4, standard rock bolt anchor 5 such as resin grout, roof plate 6 and yielding element 7.

Figure 4:
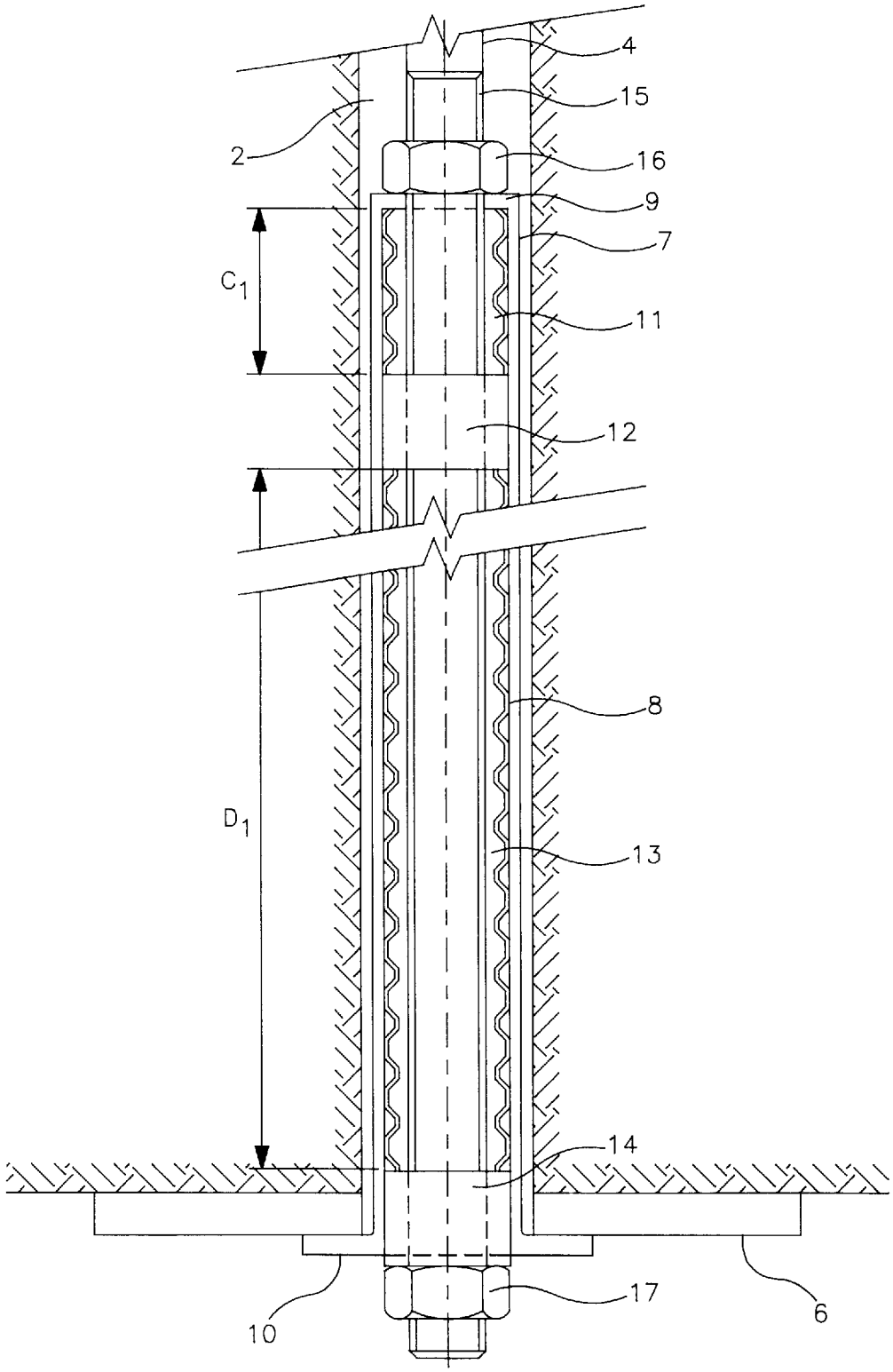
FIG. 4 is a side view cross section showing the yielding means of the preferred embodiment of a yielding rock bolt according to the present invention, in the initial position.

The side view cross section of a preferred embodiment of the yielding element 7 is illustrated in FIG. 4. The yielding element 7 consists of a cylinder 8 with a bottom plate 9 on one end and open collar 10 on the other end. Yielding elements 11 and 13, placed within the cylinder 7, have different yielding properties. The low yield strength corrugated sleeve 11, whose length is $C_1$, is located between the bottom plate 9 and the spacer 12. The high yield strength corrugated sleeve 13, whose length is $D_1$, is located between the spacer 12 and the spacer 14. The yielding element 7 is held on the threaded part 15 of the rock bolt rod 4 by nuts 16 and 17. The nut 17 is used to rotate the rock bolt assembly 1 with the yielding element 7 during the installation in the hole 2 against the roof plate 6. The yielding elements 11 and 13 are designed to deform at two predetermined levels of load on the roof plate 6.

Figure 5:
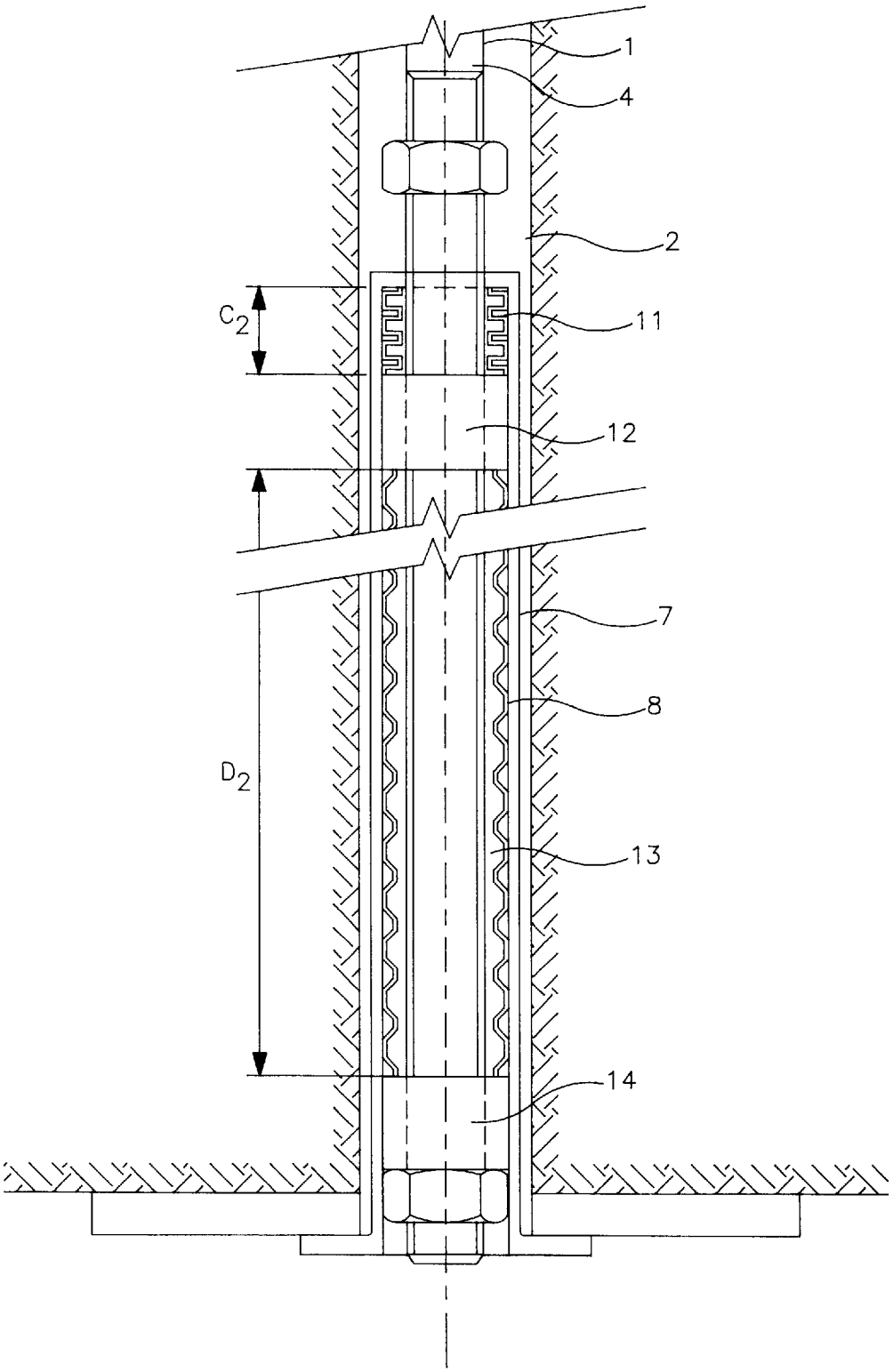
FIG. 5 is a side view cross section showing the yielding means of the preferred embodiment of a yielding rock bolt according to the present invention with the first yielding means partially yielded.

The side view cross section of the yielding element 7 with low yield strength corrugated sleeve 11 deformed to the length $C_2$ is illustrated in FIG. 5.

Figure 6:
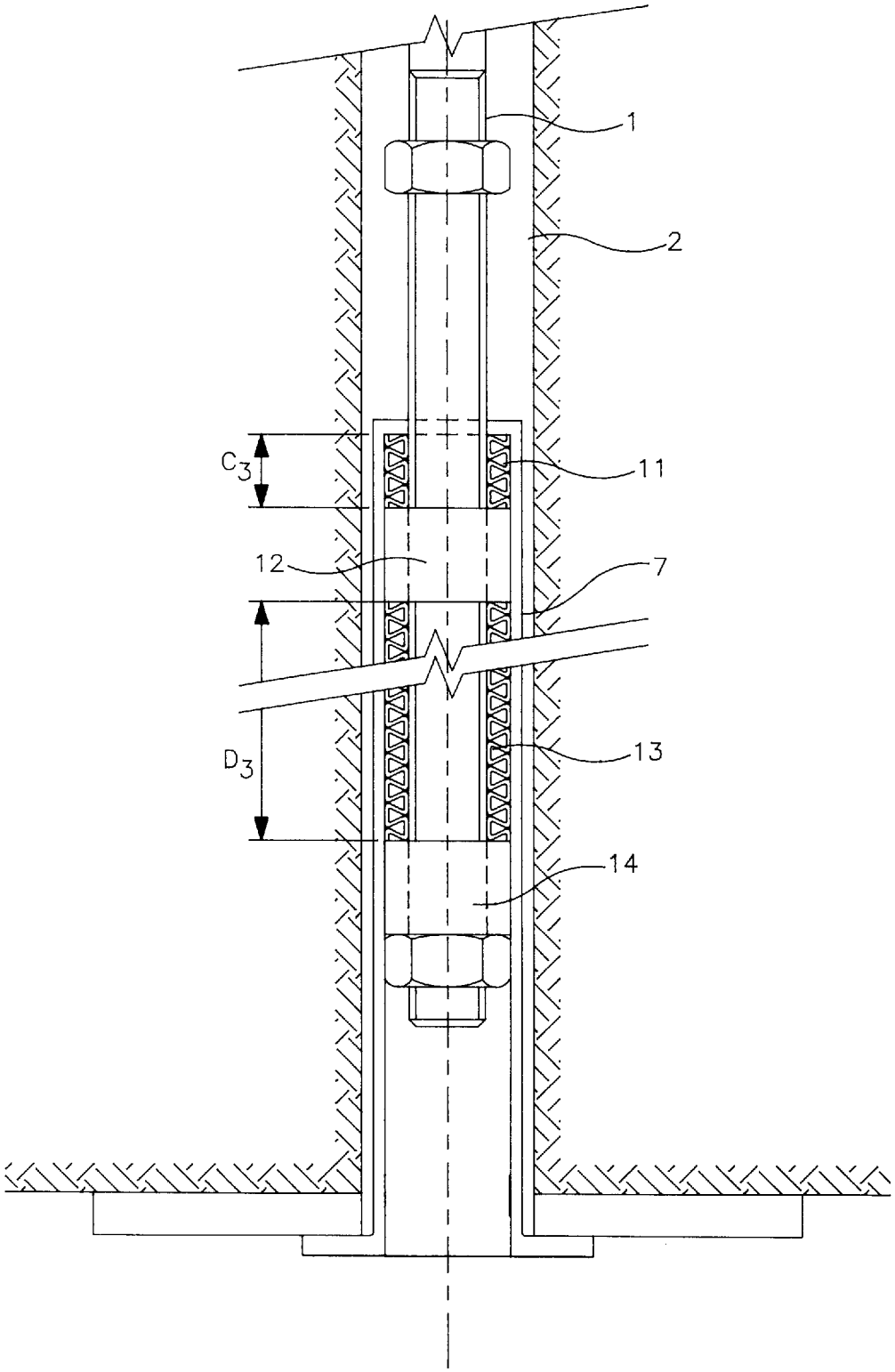
FIG. 6 is a side view cross section showing the yielding means of the preferred embodiment of a yielding rock bolt according to the present invention, with the first yielding means completely yielded and second yielding means partially yielded.

The side view cross section of the yielding element 7 with low yield strength corrugated sleeve 11 deformed to the final length $C_3$ and the high yield strength corrugated sleeve 13 deformed to the length $D_3$ is illustrated in FIG. 6.

Figure 7:
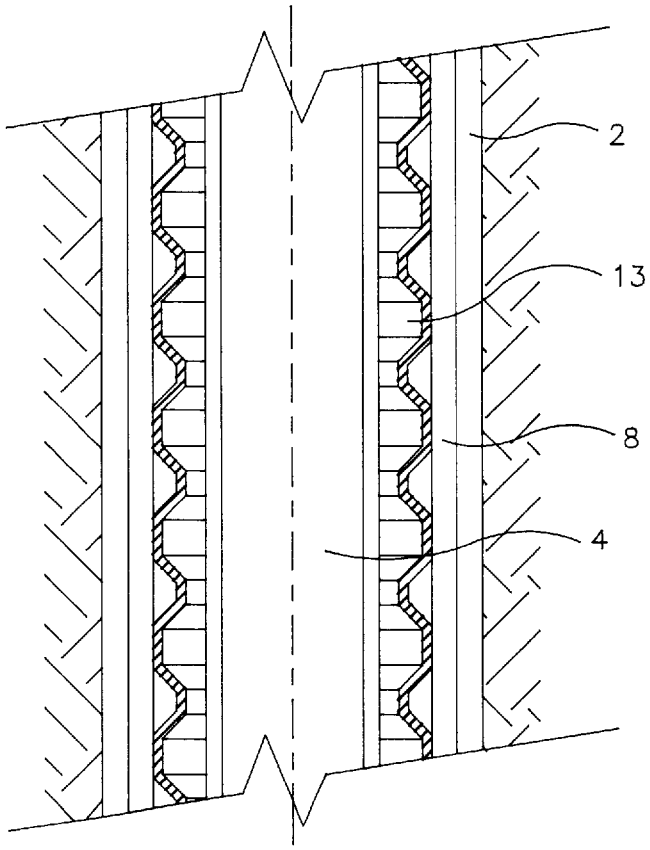
FIG. 7 is a detailed side view cross section of the yielding means used in the embodiment of FIG. 5, before yielding.

The side view cross section of the preferred embodiment of the corrugated sleeve 13 within the cylinder 8, before any deformation, is illustrated in FIG. 7. Such corrugated sleeve can be manufactured from a suitable ductile material such as ductile iron, steel, metal ally, plastic or other materials.

Figure 8:
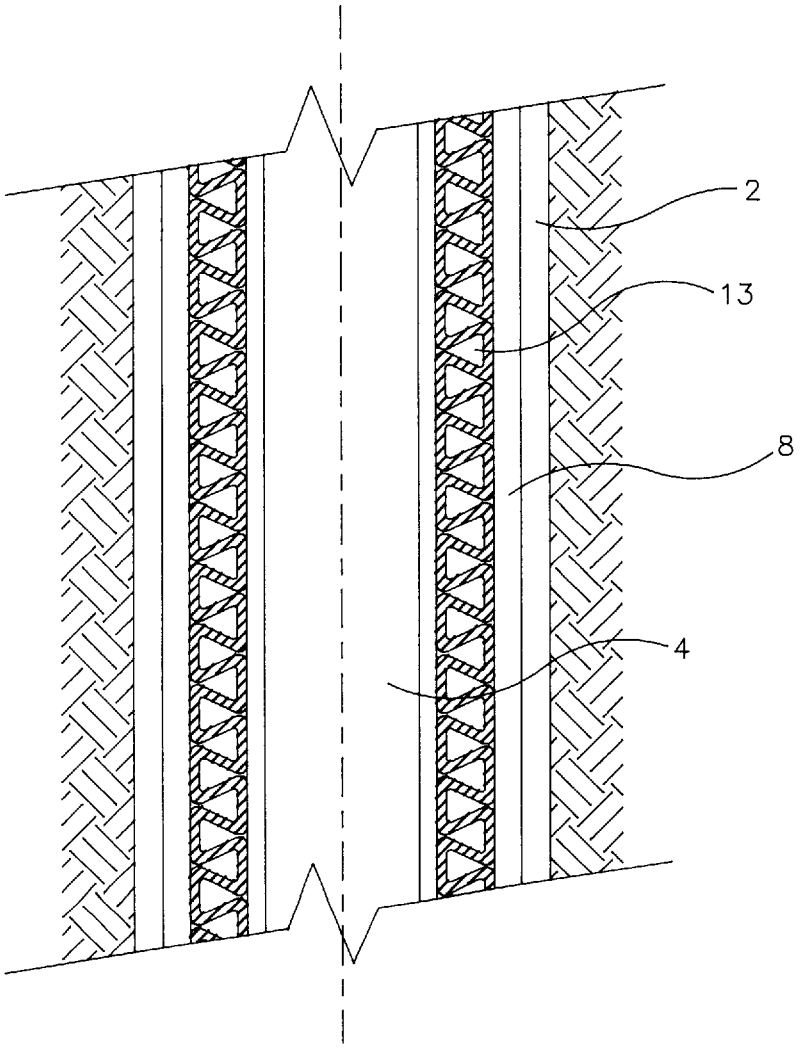
FIG. 8 is a detailed side view cross section of the yielding means used in the embodiment of FIG. 5, after yielding.

The side view cross section of the corrugated sleeve 13 within the cylinder 8, deformed to about 50% of it's original length, is illustrated in FIG. 8.

Figure 9:
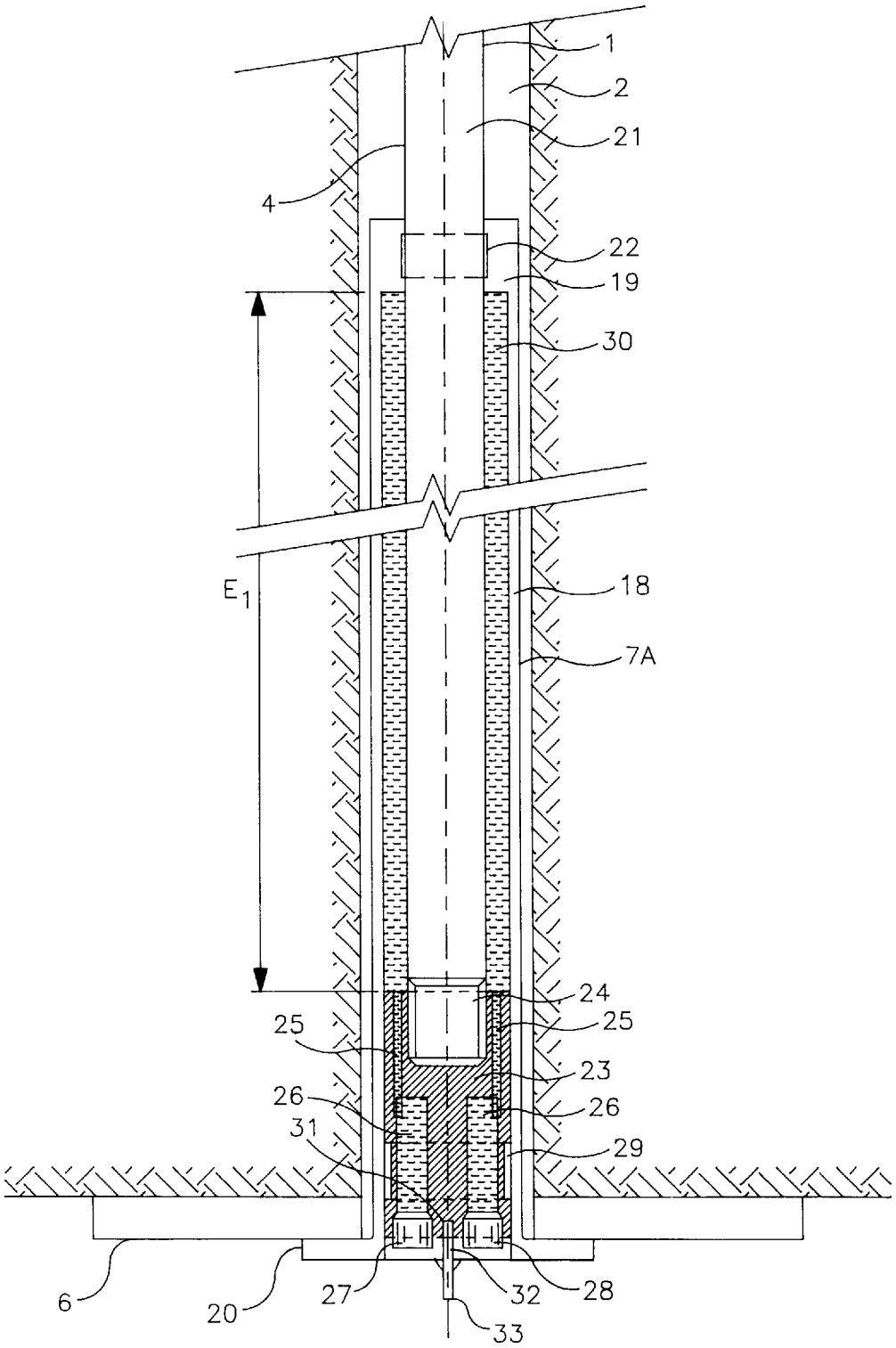
FIG. 9 is a side view cross section showing the yielding means of another embodiment of a yielding rock bolt according to the present invention, in the initial position.

Another embodiment of the yielding element 7 is illustrated in FIG. 9. The yielding element 7A consists of a cylinder 18 with a bottom plate 19 on one end and an open collar 20 on the other end. Rock bolt rod 21 is inserted through the bottom plate 19 containing seal 22 to prevent leakage of hydraulic fluid 30 from the cylinder 18. Piston 23 is attached to the threaded end 24 of the rod 21. Two or more ports 25 and 26 are drilled within the piston 23. The ends of ports 26 are threaded to accommodate pressure relief valves 27 and 28. Piston 23 contains seal 29 to prevent leakage of hydraulic fluid 30 from the cylinder 18. When the piston 23 is located near the collar 20, at the distance $E_1$ from the bottom plate 19 of the cylinder 18, the key 32 is inserted into the key slot 31. The key 32 is a part of installation plate 33 welded to the collar 20. Installation plates 33 are used to rotate the rock bolt 4 with the yielding element 7A during the installation in the hole 2 against the roof plate 6. The pressure relief valves 27 and 28 are designed to release hydraulic fluid 30 at two predetermined levels of load on the roof plate 6, thus allowing reduction of the distance $E_1$ and extension of the rock bolt assembly 1.

Figure 10:
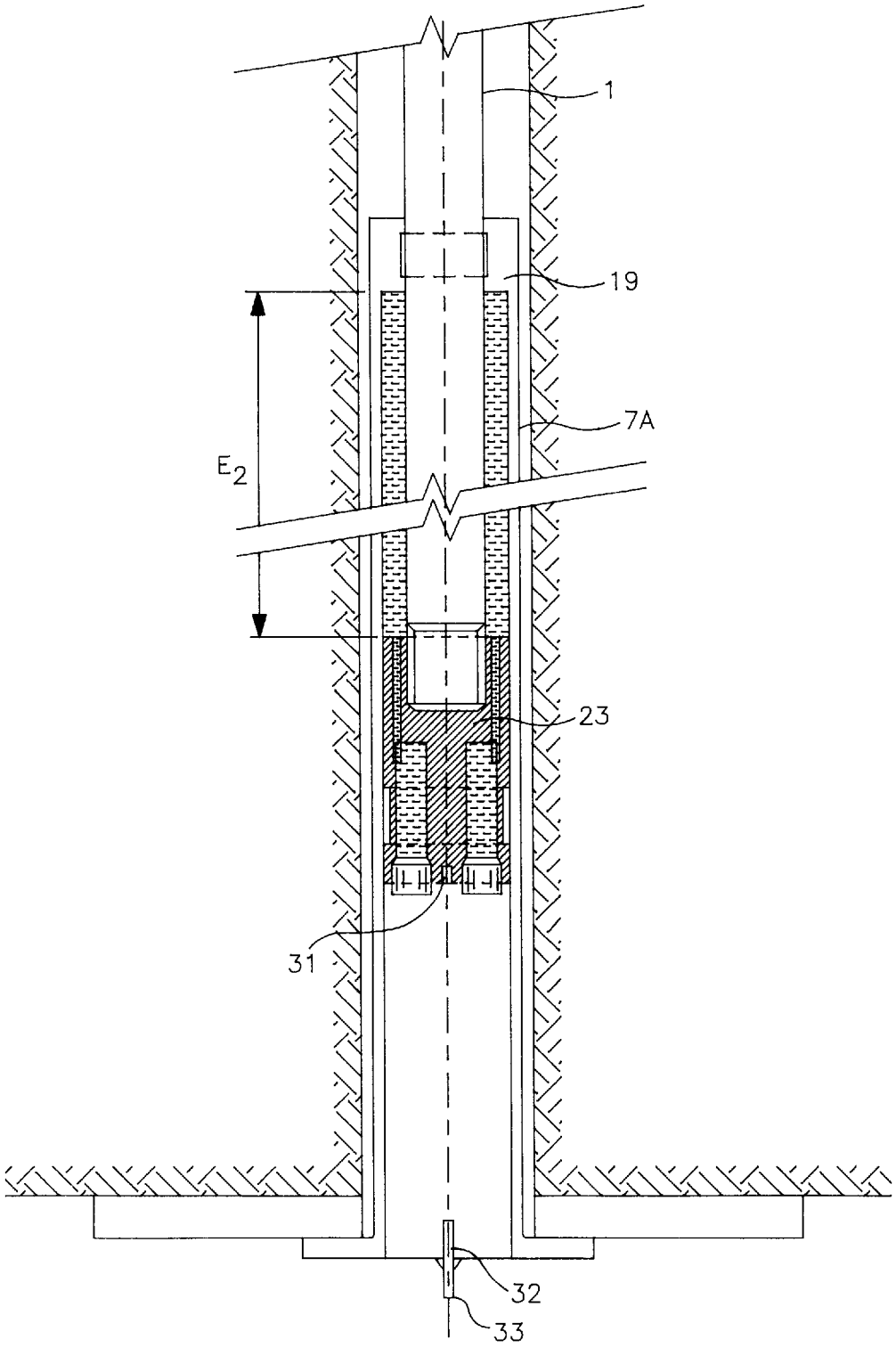
FIG. 10 is a side view cross section showing the yielding means of another embodiment of a yielding rock bolt according to the present invention, after yielding.

The side view cross section of the yielding element 7A with the distance between the bottom plate 19 and the piston 23 reduced to the length $E_2$ is illustrated in FIG. 10.

Figure 11:
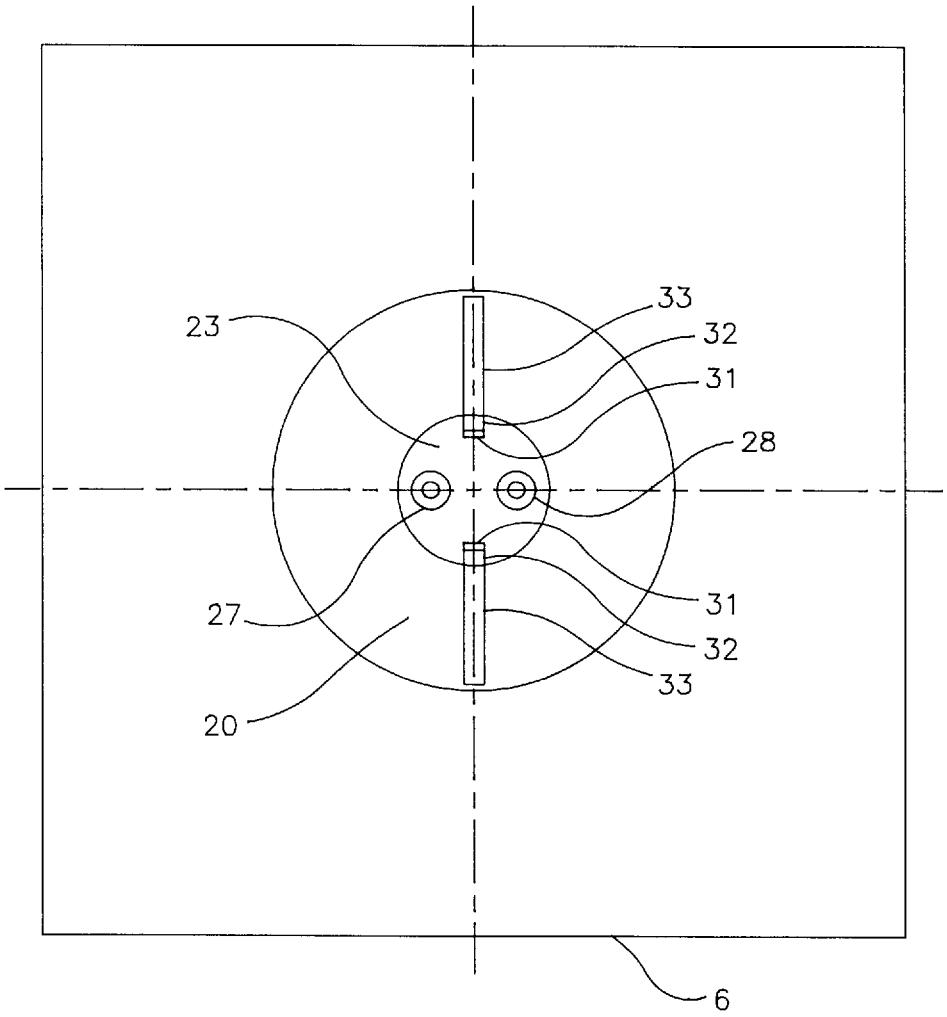
FIG. 11 is a plan view of a yielding rock bolt according to FIGS. 9 and 10.

The plan view of the yielding element 7A is illustrated in FIG. 11. Installation plates 33, welded to the open collar 20, contain keys 32 which are inserted into the key slots 31 in the piston 23 with pressure relief valves 28.

Numerous modifications and adaptations of the present invention will be apparent to those skilled in the art and it is intended to cover by the following claims all such modifications and adaptations which fall within the true spirit and scope of the invention.

What is claimed is:

1. An apparatus for yielding rock support, comprising:

a rock bolt assembly, a cylinder within the rock bolt assembly, and one or more corrugated sleeves within the cylinder, where yielding is achieved by compressing the one or more corrugated sleeves within the cylinder, where the one or more corrugated sleeves are made of non-ferrous metal, and where two or more levels of load are maintained by compressing two or more assemblies of structural washers with different yield strengths.

2. An apparatus for yielding rock support, comprising:

a rock bolt assembly, a cylinder within the rock bolt assembly, and one or more corrugated sleeves within the cylinder, where yielding is achieved by compressing the one or more corrugated sleeves within the cylinder, where the one or more corrugated sleeves are made of non-ferrous metal, and where two or more levels of load are maintained by compressing two or more assemblies of structural washers with different lengths.

3. An apparatus for yielding rock support, comprising:

a rock bolt assembly, a cylinder within the rock bolt assembly, one or more corrugated sleeves within the cylinder, and one or more structural washers made of ductile iron or steel, where yielding is achieved by compressing the one or more corrugated sleeves within the cylinder, and where the one or more sleeves are made of non-ferrous metal.

4. An apparatus for yielding rock support, comprising:

a rock bolt assembly, a cylinder within the rock bolt assembly, one or more corrugated sleeves within the cylinder, and two or more assemblies of structural washers made of plastic, where yielding is achieved by compressing the one or more corrugated sleeves within the cylinder, and where the one or more corrugated sleeves are made of non-ferrous metal.

5. An apparatus for yielding rock support, comprising:

a rock bolt assembly, a cylinder containing fluid within the rock bolt assembly, and one or more pressure relief valves coupled to the cylinder, where yielding is achieved by expelling fluid through the one or more pressure relief valves from the cylinder.

6. An apparatus for yielding rock support as per claim 5 where two or more levels of load are achieved by two or more of said pressure relief valves set at different pressure levels.

7. An apparatus for yielding rock support, comprising:

a rock bolt assembly, a cylinder containing compressed gas within the rock bolt assembly, and one or more pressure relief valves coupled to the cylinder, where yielding is achieved by expelling compressed gas through the one or more pressure relief valves from the cylinder.

8. An apparatus for yielding rock support as per claim 7 where two or more levels of load are achieved by two or more of said pressure relief valves set at different pressure levels.

* * * * *